US006673408B1

(12) United States Patent
Roth

(10) Patent No.: US 6,673,408 B1
(45) Date of Patent: Jan. 6, 2004

(54) DISK LABEL ENVELOPE LAMINATE

(75) Inventor: Joseph D. Roth, Springboro, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 10/206,519

(22) Filed: Jul. 26, 2002

(51) Int. Cl.[7] ..... B65D 27/00

(52) U.S. Cl. ..... 428/40.1; 40/340; 40/638; 156/227; 156/277; 206/232; 206/308.1; 229/71; 229/75; 428/41.7; 428/42.1; 428/42.2; 428/42.3; 428/43; 428/64.1; 428/66.5; 428/192

(58) Field of Search ..... 428/40.1, 41.7, 428/42.1, 42.2, 42.3, 43, 64.1, 66.5, 192; 206/232, 308.1; 40/340, 638; 229/71, 75; 156/227, 277

(56) References Cited

U.S. PATENT DOCUMENTS 5,348,216 A * 9/1994 Scott ..... 229/75
6,514,588 B2 2/2003 Rosenbaum et al.
6,523,737 B1 * 2/2003 Flynn ..... 229/71

* cited by examiner

*Primary Examiner*—Nasser Ahmad
(74) *Attorney, Agent, or Firm*—Francis L. Conte

(57) ABSTRACT

A laminate is provided for both labeling a data disk and creating an envelope for storing thereof. The laminate includes a base sheet having first and second pages joined together at a primary fold line. Flaps extend along corresponding edges of one of the pages at secondary fold lines in a configuration to form a closed envelope when folded together. A patch is laminated to the first page by layers of adhesive and release. The patch or first page includes a circular diecut defining a removable disk label having the adhesive on the back thereof.

20 Claims, 4 Drawing Sheets

DISK LABEL ENVELOPE LAMINATE

BACKGROUND OF THE INVENTION

The present invention relates generally to stationery products, and, more specifically, to label laminates.

Stationery products include various forms of specialized labels. A typical label laminate includes a siliconized release liner having a thin layer of silicone forming a release surface on one side thereof. Label paper is laminated to the liner using a pressure sensitive adhesive therebetween. Individual labels are defined by perimeter diecuts.

In use, the sheets of label laminate may be passed through standard laser or ink jet printers for printing any desired information atop the corresponding labels. Individual labels may then be removed by peeling from the underlying liner which carries with the label the pressure sensitive adhesive on the back thereof since the adhesive forms a weak bond with the silicone release material of the liner. The removed labels are then affixed to the intended substrate, and typically permanently bonded thereto using the same pressure sensitive adhesive.

Compact disks (CD) and digital versatile disks (DVD) are enjoying successful commercial use for storing large amounts of data in the form of music, video, or technical data. It is now common for the typical home consumer to record data on CD/DVD disks using a personal computer. Blank disks are commercially available, and when recorded require suitable labeling thereof to identify the contents of the disk.

Specialty label laminates are presently available for creating disk labels printed with any desirable information thereon. One or more circular disk labels are die cut in a label sheet atop an underlying liner. After printing of the individual disk labels, they may simply be peeled away from the liner and affixed to the label side of the recorded disk.

The labeled disks must then be suitably stored to prevent scratching or other damage thereto. Plastic jewel cases are commercially available for storing the recorded disks, typically with one disk per case. The individual cases are bulky and typically require jewel case inserts for identifying the contents thereof.

Sleeves of paper or other suitable material are also available for storing individual recorded disks. However, individual sleeves are not configured for transport through a typical laser or ink jet printer for printing thereatop.

Accordingly, it is desired to provide a single stationery product for both labeling and storing data disks in the exemplary form of CDs or DVDs.

BRIEF SUMMARY OF THE INVENTION

A laminate is provided for both labeling a data disk and creating an envelope for storing thereof. The laminate includes a base sheet having first and second pages joined together at a primary fold line. Flaps extend along corresponding edges of one of the pages at secondary fold lines in a configuration to form a closed envelope when folded together. A patch is laminated to the first page by layers of adhesive and release. The patch or first page includes a circular diecut defining a removable disk label having the adhesive on the back thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
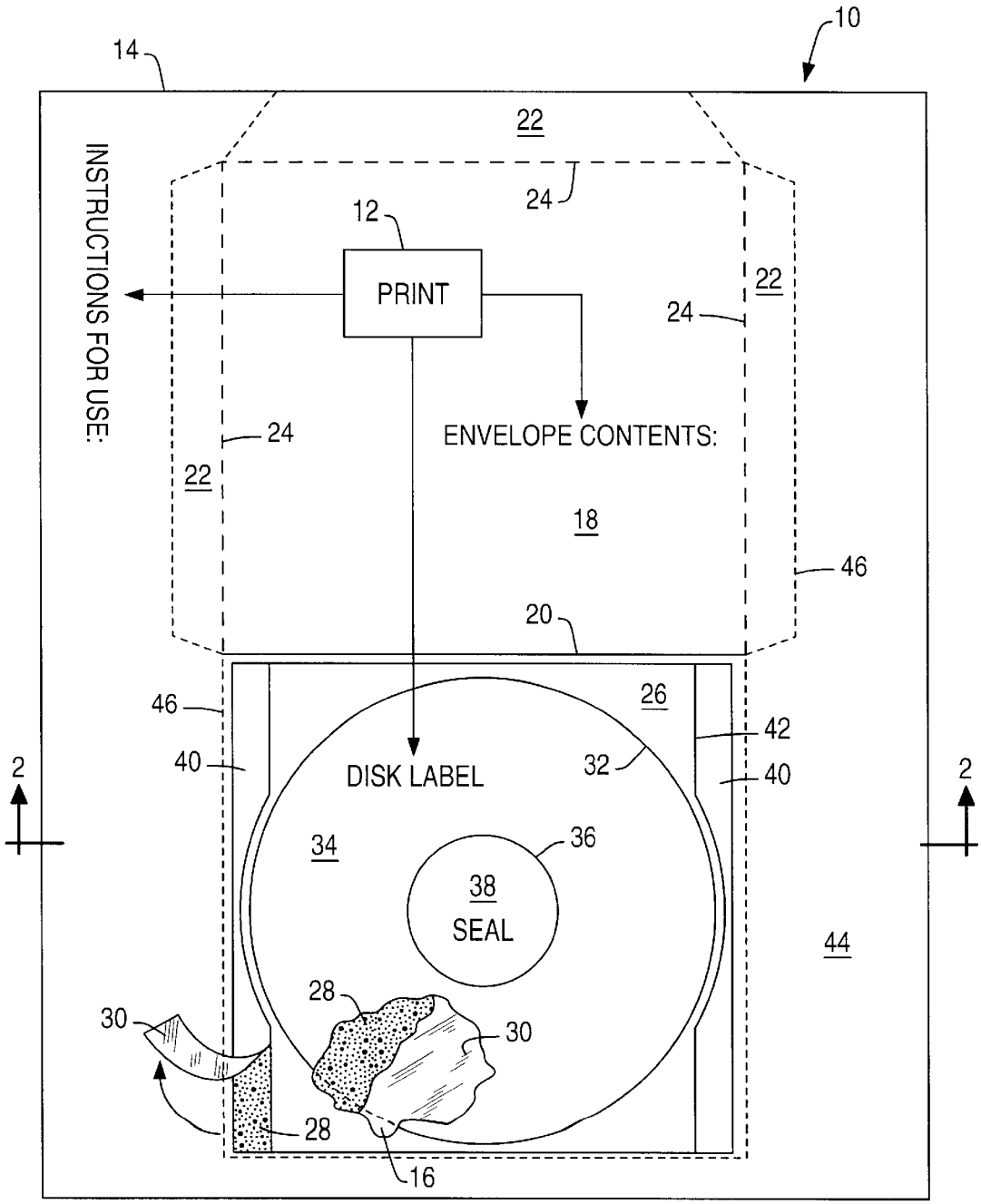
FIG. 1 is plan view of disk label envelope laminate in accordance with an exemplary embodiment of the present invention.

Illustrated in FIG. 1 is a disk label envelope laminate 10 in original sheet form for use in a standard printer 12, such as a laser or ink jet printer. The laminate includes a base sheet ply or layer 14 which may have any standard configuration, such as 8½ by 11 inch rectangular.

The base sheet is flat and has first and second leaf portions or pages 16,18 integrally joined together at a primary fold line 20 which may have any conventional configuration, such as being scored or perforated or simply a printed line.

Three flaps 22 extend along corresponding edges of the second page 18 in this exemplary embodiment at corresponding secondary fold lines 24. The secondary fold lines may have any conventional configuration such as being scored, perforated, or simply printed lines.

In the preferred embodiment illustrated in FIG. 1, the three secondary fold lines 24 and the primary fold line 20 define a square second page 18 substantially equal in size to the first page 16 also being square. In this way, the four fold lines of the second page 18 are symmetric with the first page 16 in a configuration for forming a closed envelope when the two pages are folded together and closed by the corresponding flaps.

The laminate further includes a substantially square patch 26 which is a flat second ply or layer laminated to the first page 16 by adjoining layers of adhesive 28 and release 30. The adhesive may have any conventional form, such as typical pressure sensitive adhesive used in typical label sheets, and may have any suitable bond strength such as being weak with the release 30 and permanent with typical substrates such as paper or plastic, for example. The release 30 may have any conventional configuration, such as conventional silicone which is typically applied as a liquid release agent or material atop an exposed surface and suitably cured to provide a temporary or weak bond with the adhesive.

The smaller patch 26 and the larger base sheet 14 are laminated together by the adhesive into a two-ply laminate 10. In the first embodiment illustrated in FIG. 1, the patch 26 defines a label patch, and the base sheet 14 defines a liner formed of any suitable material such as supercalendared kraft (SCK) paper on which the silicone release 30 is suitably provided in a patch corresponding with the label patch. The label patch includes a first circular diecut 32 which defines a removable disk label 34 having the adhesive 28 on the back side thereof. The release 30 is disposed on the hidden back side of the first page 16 in alignment with the disk label 34 laminated therewith.

Figure 2:
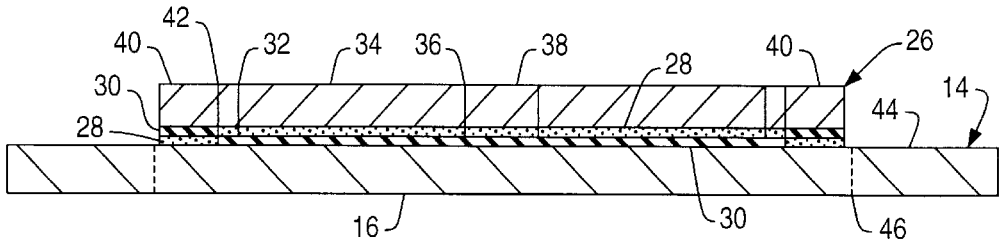
FIG. 2 is a transverse sectional view through the laminate illustrated in FIG. 2 and taken along line 2—2.

FIG. 2 illustrates a cross section through the label patch 26 and the liner base sheet 14. Disposed concentrically in the disk label 34 is a second circular diecut 36 at the center thereof which defines a removable center label 38 which also has adhesive on the back side thereof. Both labels 34,38 are circular and have adhesive covering the back sides thereof in alignment with the silicone release 30 on the back side of the first page 16 of the base sheet defining the cooperating release liner. The center label 38 is a circular disk, whereas the disk label 34 defines an annulus with circular outer and inner perimeters defined by the corresponding diecuts.

The label patch 26 is preferably square to circumscribe the disk label centrally therein. The patch further includes a pair of removable side strips 40 disposed along opposite edges of the disk label, and defined by corresponding longitudinal diecuts 42 extending perpendicularly to the primary fold line 20 along the longitudinal direction of the elongate base sheet 14.

Since the base sheet 14 is preferably rectangular in standard size for use in a typical printer, it is larger than necessary for producing a disk label and sleeve envelope for a single standard-sized disk. Accordingly, the base sheet also includes a scrap border 44 adjoining the first and second pages at corresponding lines of tear perforations 46. In this way, the scrap border may be readily removed from the two pages after the entire sheet is first passed through the printer for printing any suitable information or graphics thereon.

The scrap border 44 preferably surrounds the first and second pages 16,18 and the corresponding flaps 22 thereat except at the top flap which is coincident with the top edge of the base sheet. In this configuration, one disk label 34 and one envelope may be formed in a single standard sheet of 8½ by 11 inch configuration. The scrap border may be otherwise configured around the first and second pages as desired.

In the preferred embodiment illustrated in FIG. 1 the three flaps 22 are disposed on three edges of the second page 18, and the label patch 26 includes three exposed edges symmetrically disposed with the three secondary fold lines 24 about the primary fold line 20. The fourth exposed edge of the label patch is generally coincident with the primary fold line 20.

In this configuration, the first and second pages may be folded together at the primary fold line 20, with the edges of the label patch being aligned with the corresponding secondary fold lines 24 of the first page. The three flaps of the first page may then be folded over the corresponding three edges of the second page to create a sleeve envelope.

In the preferred embodiment illustrated in FIG. 2, the side strips 40 include the release 30 on the backs thereof which face the first page liner, and the first page liner further includes the adhesive 28 in alignment with the two strips. Note in FIG. 2 that the first page 16 below the disk label 34 defines a typical release liner having release 30 thereon providing a weak bond with the adhesive 28 underlying the disk label.

However, the strip portions of the label patch include strips of the release agent 30 thereon instead of adhesive, with the adhesive 28 instead being applied atop the first page 16 laterally outboard of the central silicone release agent thereon. This configuration is later used to form the envelope as described hereinbelow.

Figure 3:
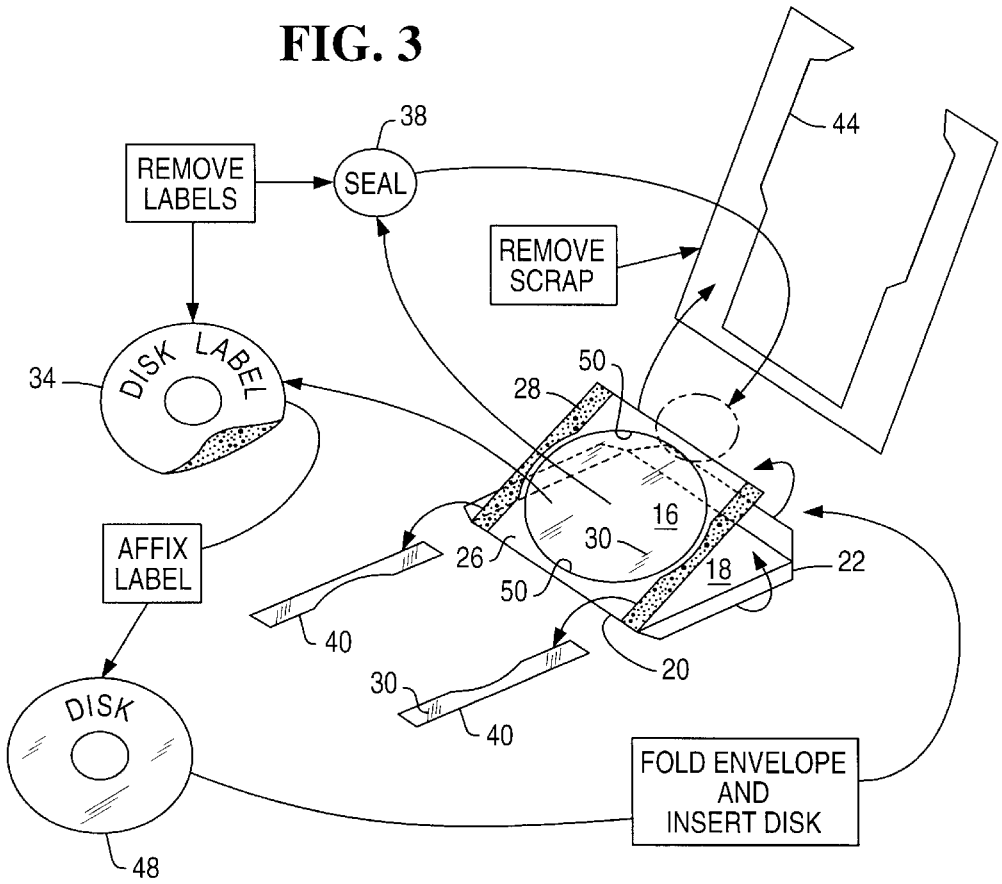
FIG. 3 is an exploded view of the laminate illustrated in FIG. 1, and an exemplary method of use of use thereof for labeling and storing a disk.

FIG. 3 illustrates in exploded view a method of using the laminate 10 illustrated in FIG. 1. As initially shown in FIG. 1, the initially flat laminate is passed through the printer 12 for printing any desired information or graphics both on the disk label 34 and the second page 18 in one pass through the printer. The center label 38 may also be printed for use as a security seal if desired, and instructions for use of the multiple function laminate sheet may be printed on the scrap border 44.

As shown in FIG. 3, the printed disk label 34 may be removed by peeling away from the release 30 atop the underlying first page 16, and then affixed to a conventional data disk 48, such as a CD or DVD disk. The printed disk label may have any information thereon for identifying the contents of the data recorded on the disk, and including any desired graphics.

The scrap border 44 may then be removed from both the first and second pages by simple tearing along the lines of perforation 46 surrounding the two pages. The remaining base sheet is then suitably folded in half about the primary fold line 20 so that the back sides of the two pages become the inside of the envelope. Correspondingly, the front sides of the two pages become the outside of the envelope.

The two side strips 40 may then be removed from the label patch to expose the adhesive 28 on the two edges of the first page. The two side flaps 22 of the second page 18 may then be folded over the adhesive edges of the first page to create permanent bonds therewith and form a sleeve envelope initially open at the top flap 22 opposite to the primary fold line 20.

The disk 48 containing the disk label 34 may then be inserted inside the open end of the envelope past the third or top flap. The third flap may then be folded closed atop the label patch.

In this configuration, no adhesive is provided on the first page 16 for affixing the third flap. Instead, the center label 38 may be removed from the first page and repositioned across the third flap and label patch for bridging closed the envelope.

As shown in FIG. 3, removal of the disk label 34 from the first page 16 leaves a circular recess or well 50 having exposed release 30 thereatop. The base sheet is preferably folded about the primary fold line 20 to expose the well 50 and release 30 on the outside of the resulting envelope.

Accordingly, bridging the center label 38 across the top flap and the first page 16 forms a permanent bond with the top flap and a temporary bond with the release material 30 inside the well 50 on which a portion of the center label rests. The third flap may therefore be conveniently reopened by peeling up the seal label 38 when desired for removing or reinserting the labeled disk.

The two-ply laminate 10 illustrated in FIG. 1 therefore enjoys the benefits of one-pass printing in a typical printer of both the disk label 34 and any desired portions of the external surface of the resulting envelope. The disk label is conveniently affixed to the CD/DVD disk for providing suitable labeling thereof, and that disk may then be stored in the resulting envelope or sleeve formed by simple folding of the remaining two pages.

Adhesive is provided on two of the edges of the first page 16 for permanent bonding with the corresponding two flaps 22 of the second page 18. A square envelope is thusly created with an open top at the third flap through which the disk may be inserted or removed. And, if desired, the third flap may be adhesively bonded to the first page 16 using the center label 38, or otherwise providing adhesive. It is noted that the center label 38 is removed from the disk label 34 to leave exposed the center aperture of the disk for use in a typical CD/DVD player.

The resulting disk envelope may have any suitable printing on its external surfaces for identifying the contents of the disk stored therein. However, in view of the versatility of the two-ply laminate illustrated in FIGS. 1–3, it is possible to make various changes in the configuration and composition thereof for enjoying additional benefits. For example, the laminate 10 and resulting envelope in the first embodiment are opaque, whereas a portion of the resulting envelope may instead be transparent for directly viewing the contents of the envelope.

Figure 4:
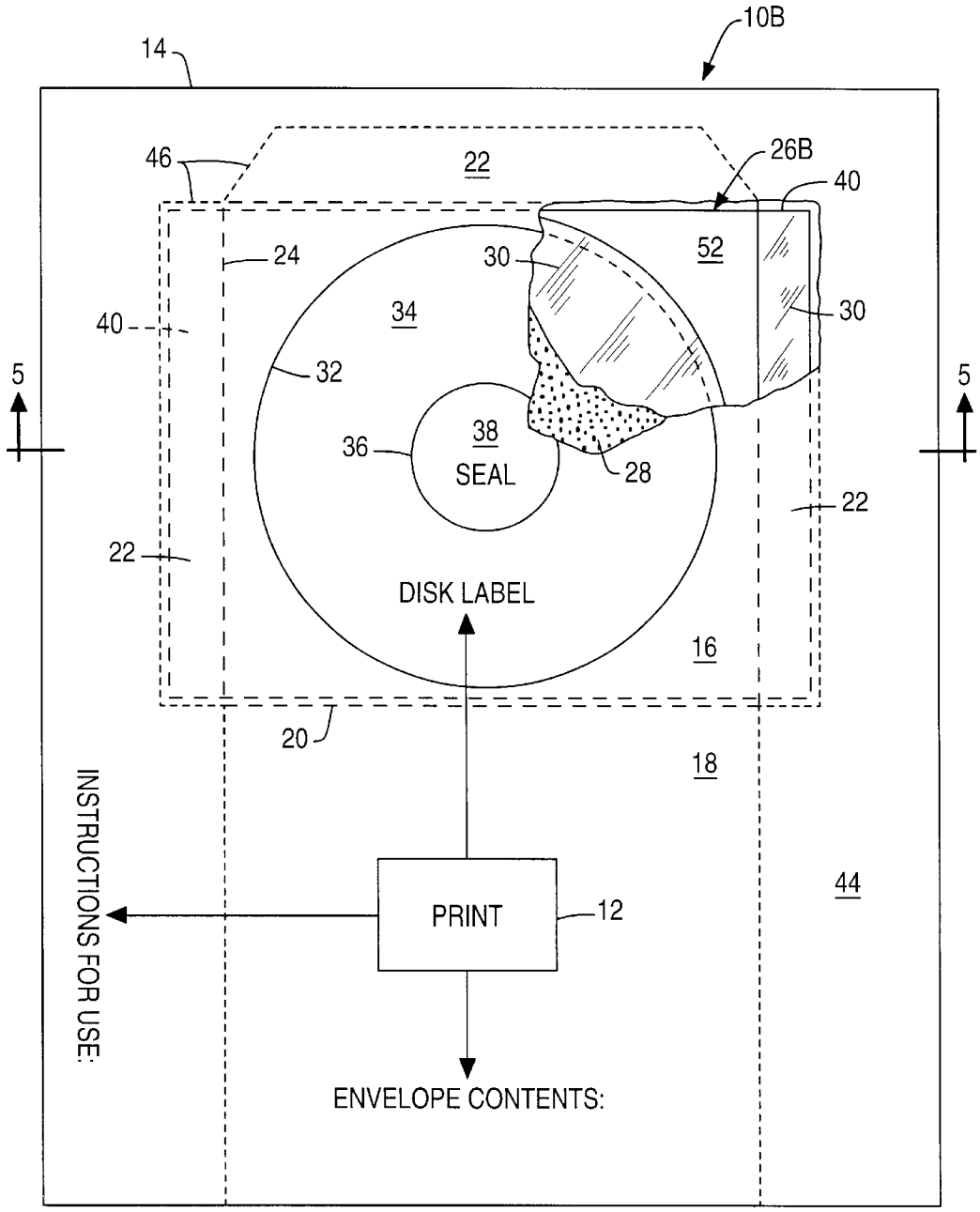
FIG. 4 is a plan view of a disk label envelope laminate in accordance with another embodiment of the present invention.
Figure 5:
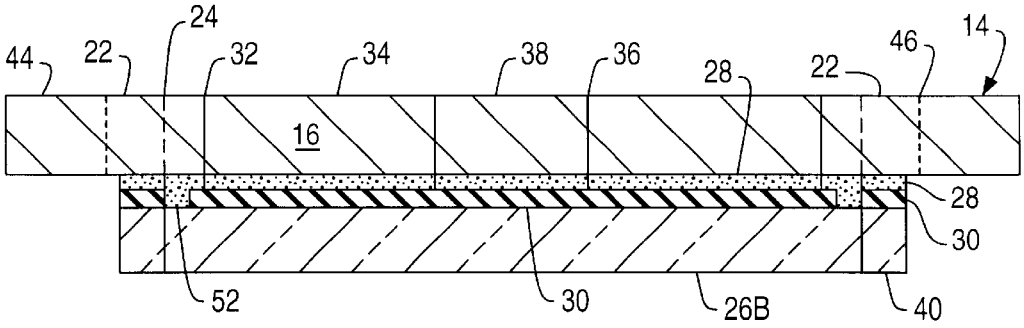
FIG. 5 is transverse sectional view through the laminate illustrated in FIG. 4 and taken along line 5—5.
Figure 6:
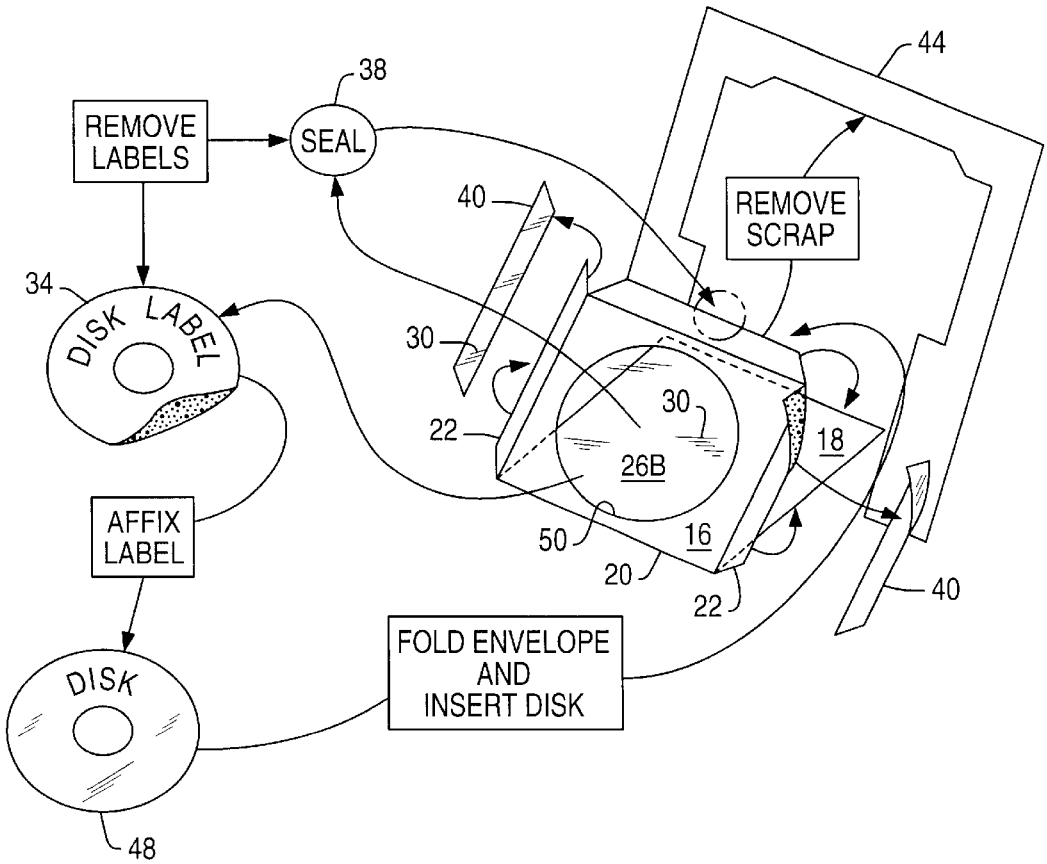
FIG. 6 is an exploded view of the laminate illustrated in FIG. 4, and method of use thereof for labeling a disk.

More specifically, FIGS. 4–6 illustrate an alternate embodiment of the disk label envelope laminate, designed 10B, which is similar in many respects with the first embodiment illustrated in FIGS. 1–3, and therefore uses similar reference numerals for the components thereof.

In this embodiment, the patch defines a liner patch, designated 26B, having the silicone release 30 disposed thereatop. The liner patch 26B may have any conventional composition such as the SCK paper described above, whereas the base sheet 14 may be formed of typical label material.

The first circular diecut 32 is disposed in the first page 16 to define therein the removable disk label 34 having the pressure sensitive adhesive 28 on its back side in alignment with the release agent on the liner patch.

As shown in FIGS. 4 and 5, the two side strips 40 of the liner patch 26B include the silicone release 30 on the backs thereof facing the first page, and the first page 16 further includes the adhesive 28 in alignment therewith.

In the second embodiment illustrated in FIG. 4, the three flaps 22 are disposed on the corresponding three edges of the first page 16 defined by the secondary fold lines 24. And, the liner patch 26B includes three exposed edges symmetrically disposed with the secondary fold lines about the primary fold line 20. In this way, the first and second pages 16,18 again have square configurations for forming a substantially square envelope for storing the circular disk therein.

In the alternate embodiment illustrated in FIG. 4, the scrap border 44 surrounds the first and second pages 16,18 except at the bottom edge of the second page 18, which bottom edge is coincident with the bottom edges of the scrap border. The various features of the envelope may be introduced in the base sheet 14 with suitable configurations of the surrounding border 44 as desired. The scrap border may be minimized to conform with the maximum dimensions required in the laminate for forming the resulting envelope. And, the scrap border should maintain the rectangular configuration of the laminate to ensure proper transport through typical printers available in the industry, including low cost personal printers.

As shown in FIG. 4, the liner patch 26B preferably includes its own border 52 surrounding the disk label 34 slightly outside the circular diecut 32, which liner border is also disposed inboard of the two side strips 40. The liner border as illustrated in FIG. 4 is preferably devoid of the release agent 30, and is permanently laminated to the first page 16 by the common adhesive 28 therebetween as best illustrated in FIG. 5. In this way, the liner patch 26B is locally locked to the first page 16 notwithstanding the low-strength bonds formed at the release agent 30 over a majority of the liner patch.

Of particular benefit in the embodiment illustrated in FIGS. 4–6 is the use of a clear or transparent liner patch 26B. Clear release liners are conventional, and include, for example, clear plastic such as polyethylene terphthalate with a siliconized surface for the release layer. Alternatively, glassine paper may also be siliconized for use as a clear release liner.

The particular advantage of the clear release liner is shown in the method of use of the laminate illustrated in FIG. 6. The method illustrated in FIG. 6 is substantially identical to that illustrated in FIG. 3, except as modified for the differences in construction of the laminates 10,10B.

In the method illustrated in FIG. 6, the two strips 40 are removed from the liner patch 26B to expose the adhesive. And, the two side flaps 22 of the first page 16 are folded over the corresponding edges of the second page 18 to form the envelope.

The envelope so formed is closed at its bottom edge along the primary fold line 20, and closed along its two side edges by the adhesive flaps 22 bonded to the second page, and is open at the top flap. The labeled disk 48 may then be inserted inside the envelope past the top flap, which is then closed over the second page 18. As in the first embodiment, the center label 38 may also be removed from the liner and repositioned to bridge the top flap over the second page for sealing shut the envelope with the disk inside.

Upon removal of both the disk label 34 and the center label 38 from the liner patch 26B, the remaining well 50 forms a clear or transparent window into the envelope since both the liner patch and silicone are transparent. The base sheet is preferably folded along the primary fold line 20 to expose the well on the outer surface of the formed envelope, with the perimeter edges of the liner patch being hidden inside the envelope.

Both embodiments disclosed above illustrate the versatility of using a standard size sheet for one-pass printing of a disk label and resulting envelope. The laminate sheet is locally two-ply in either label patch or liner patch configuration. Removal of the printed label leaves behind the base sheet and patch which are simply folded to form the desired envelope using the same adhesive for fixedly bonding the flap edges of the envelope. The label disk may be conveniently stored inside the so formed envelope with or without permanent closing of the top flap. And, the envelope may be formed of clear or transparent material for viewing its contents when formed.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within. the true spirit and scope of the invention.

Accordingly, what is desired to be secured by Letters Patent of the United States is the invention as defined and differentiated in the following claims in which I claim:

1. A label envelope laminate comprising:

a base sheet having first and second pages joined together at a primary fold line, and a plurality of flaps extending along corresponding edges of one of said pages at secondary fold lines in a configuration to form a closed envelope when folded together;

a label patch including adhesive on the back thereof laminated to release disposed on said first page in alignment therewith;

said label patch including a first diecut defining a removable disk label having said adhesive on the back thereof, and a pair of removable strips disposed along opposite edges of said disk label; and said strips including release on the backs thereof, and said first page further including adhesive in alignment with said release on said strips.

2. A laminate according to claim 1 wherein said disk label includes a second diecut inside said first diecut to define a removable center label having said adhesive on the back thereof, and said disk label defines an annulus.

3. A laminate according to claim 2 wherein said removable strips are defined by corresponding longitudinal diecuts extending perpendicular to said primary fold line.

4. A laminate according to claim 3 wherein said base sheet is rectangular and includes a scrap border adjoining said first and second pages at corresponding lines of perforations.

5. A laminate according to claim 4 wherein said flaps are disposed on three edges of said second page defining said secondary fold lines; and said label patch includes three exposed edges symmetrically disposed with said secondary fold lines about said primary fold line.

6. A laminate according to claim 5 wherein said scrap border surrounds said first and second pages except at one of said flaps.

7. A method of using said laminate according to claim 5 comprising:

removing said disk label from said first page and affixing said label to a disk;

removing said scrap border from said first and second pages;

folding said base sheet about said primary fold line;

removing said strips from said label patch to expose said adhesive on said first page; and folding two of said flaps over said label patch to form an envelope for receiving said labeled disk.

8. A method according to claim 7 further comprising:

inserting said labeled disk inside said envelope past a third one of said flaps;

folding closed said third flap atop said label patch; and removing said center label from said first page and bridging said center label across said third flap and patch for closing said envelope.

9. A method according to claim 7 wherein:

removal of said disk label from said first page leaves a well having exposed release thereatop; and said base sheet is folded about said primary fold line to expose said well and release on the outside of said envelope.

10. A label envelope laminate comprising;

a base sheet having first and second pages joined together at a primary fold line, and a plurality of flaps extending along corresponding edges of one of said pages at secondary fold lines in a configuration to form a closed envelope when folded together;

a liner patch including release disposed thereatop laminated to adhesive disposed on said first page;

said first page including a first diecut defining a removable disk label having said adhesive on the back thereof; and said liner patch including a pair of removable strips disposed along opposite edges of said disk label, and a border surrounding said disk label inboard of said strips, and said border is devoid of said release and permanently laminated to said first page by said adhesive therebetween.

11. A laminate according to claim 10 wherein said strips include said release on the backs thereof, and said first page further includes said adhesive in alignment therewith.

12. A laminate according to claim 11 wherein said flaps are disposed on three edges of said first page defining said secondary fold lines; and said liner patch includes three exposed edges symmetrically disposed with said secondary fold lines about said primary fold line.

13. A laminate according to claim 12 wherein:

said disk label includes a second diecut inside said first diecut to define a removable center label having said adhesive on the back thereof, and said disk label defines an annulus; and said scrap border surrounds said first and second pages except at one edge of said second page.

14. A laminate according to claim 12 wherein said liner patch is transparent.

15. A method of using said laminate according to claim 12 comprising:

removing said disk label from said first page and affixing said label to a disk;

removing said scrap border from said first and second pages;

folding said base sheet about said primary told line;

removing said strips from said liner patch to expose said adhesive on said first page; and folding two of said flaps over said second page to form an envelope for receiving said labeled disk.

16. A method according to claim 15 further comprising:

inserting said labeled disk inside said envelope past a third one of said flaps;

folding closed said third flap atop said second page; and removing said center label from said first page and bridging said center label across said third flap and second page for closing said envelope.

17. A method according to claim 15 wherein:

removal of said disk label from said first page leaves a well having exposed release thereatop; and said base sheet is folded about said primary fold line to expose said well and release on the outside of said envelope.

18. A laminate according to claim 10 wherein said base sheet is rectangular and includes a scrap border adjoining said first and second pages at corresponding lines of perforations.

19. A method according to claim 7 further comprising printing both said disk label and second page in one pass through a printer.

20. A method according to claim 15 further comprising printing both said disk label and second page in one pass through a printer.

* * * * *